United States Patent [19]

Hansen

[11] 4,102,355

[45] Jul. 25, 1978

[54] DIAPHRAGM MULTI-PORT VALVE ASSEMBLY

[76] Inventor: Albert Frederick Hansen, Punga Grove Rd., Whangarei, New Zealand

[21] Appl. No.: 745,527

[22] Filed: Nov. 29, 1976

[51] Int. Cl.[2] ..... F15B 13/042

[52] U.S. Cl. ..... 137/596.15; 137/596.14

[58] Field of Search ..... 137/596, 596.14, 596.15, 137/596.16; 251/61.1

[56] References Cited

U.S. PATENT DOCUMENTS

| | | | |
|---|---|---|---|
| 3,080,887 | 3/1963 | Brandenberg | 137/596.14 |
| 3,760,843 | 9/1973 | Larner | 137/596.15 |
| 3,787,026 | 1/1974 | Lazar | 251/61.1 |

*Primary Examiner*—Martin P. Schwadron
*Assistant Examiner*—A. Michael Chambers

[57] ABSTRACT

A diaphragm multi-port valve assembly particularly for controlling cylinder and piston assemblies. The valve assembly has communicating chambers which are normally separated by a diaphragm, the chambers being connected by a bleed so that the pressures in the two chambers can equalize. Each chamber is connected to or separated from an appropriate port or other chamber by a pilot valve.

9 Claims, 22 Drawing Figures

DIAPHRAGM MULTI-PORT VALVE ASSEMBLY

BACKGROUND OF THE INVENTION

The present invention relates to multi-port valve assemblies particularly, but not exclusively, for controlling cylinder and piston assemblies.

SUMMARY OF THE INVENTION

According to the present invention there is provided a diaphragm valve assembly comprising a first and a second diaphragm valve each comprising a first and a second chamber separated by a diaphragm, a valve port for communication with the first chamber and normally closed by the diaphragm, bleed means connecting the first and second chambers, and control means for actuating the valves, wherein the first chamber of the first valve has an inlet for communication with a supply of fluid under pressure, the port of the first valve is adapted for connection to apparatus to be controlled by fluid under pressure and is connected to the first chamber of the second valve, the port of the second valve is adapted for connection to exhaust, and the second chambers of the valves are connected to the control means which is placeable in at least two conditions in a first of which the pressure in the second chamber of the first valve will be reduced relative to that in the first chamber to permit the diaphragm of the first valve to lift to open the port thereof and in a second of which the pressure in the second chamber of the second valve will be reduced relative to that in the first chamber to permit the diaphragm of the second valve to lift to open the port thereof.

Advantageously, in the first condition of the control means the second chambers of the valves are placed in communication and in the second condition of the control means the second chambers are isolated from each other and the second chamber of the second valve is connected to a path for fluid from the assembly.

In a preferred embodiment the bleed means comprise at least one aperture through the diaphragm. Advantageously the bleed means of the second valve provides a faster bleed blow than the bleed means of the first valve.

The present invention will be more fully understood from the following description of embodiments thereof, given by way of example only, with reference to the accompanying drawings, in which.

Figure 1:
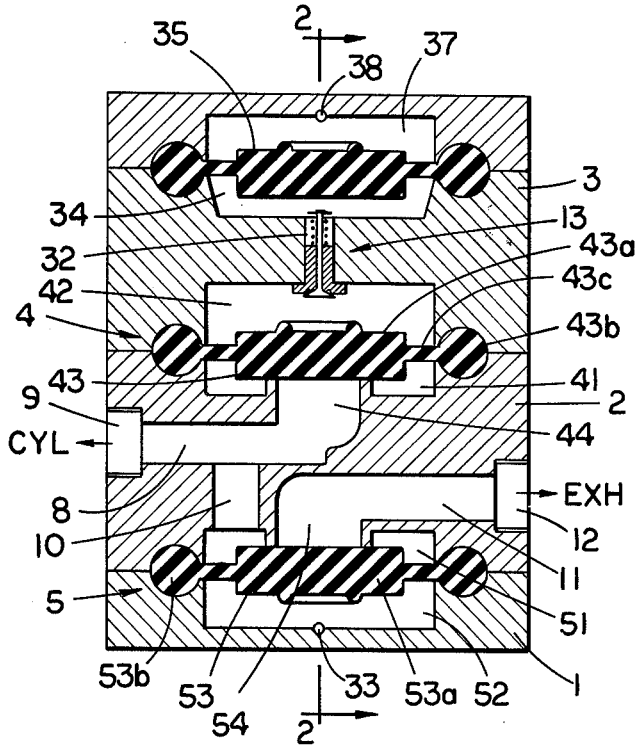
FIG. 1 is a section through an embodiment of valve assembly according to the present invention and on the line I—I of FIG. 2.
Figure 3A:
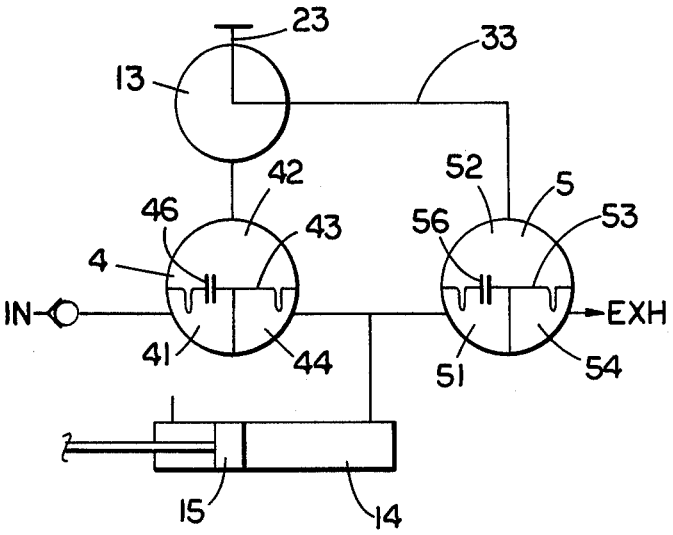
Figure 5:
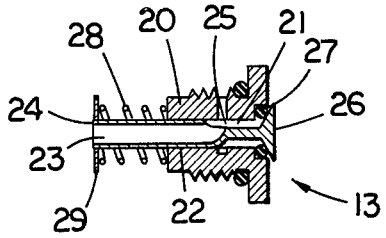
Figure 3B:
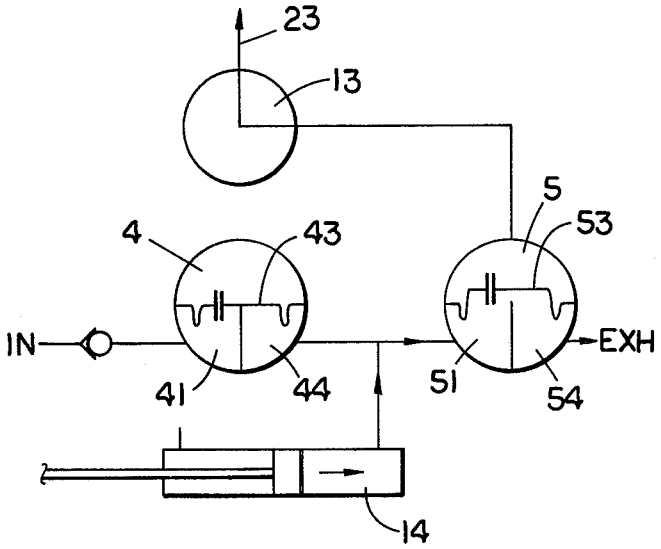
Figure 3C:
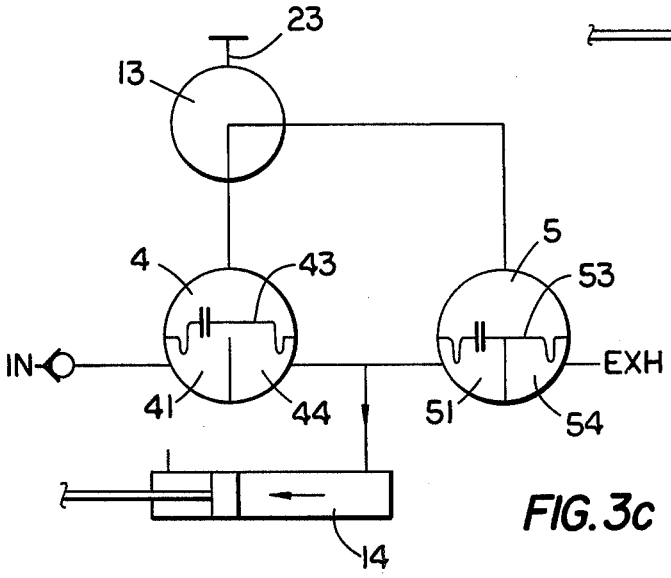
Figure 6:
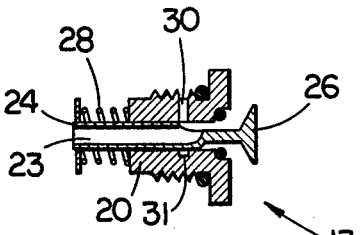
Figure 4:
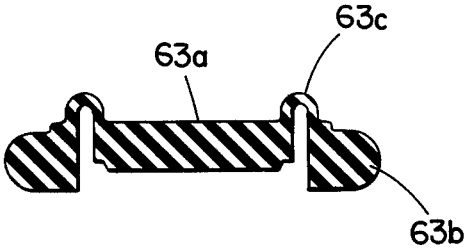
Figure 7:
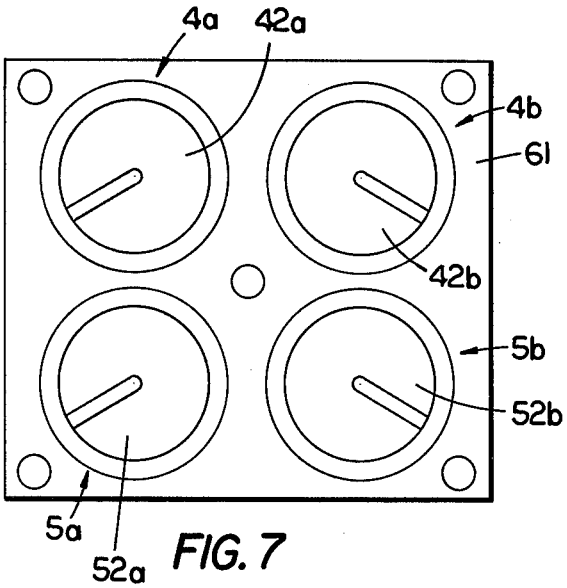
Figure 8:
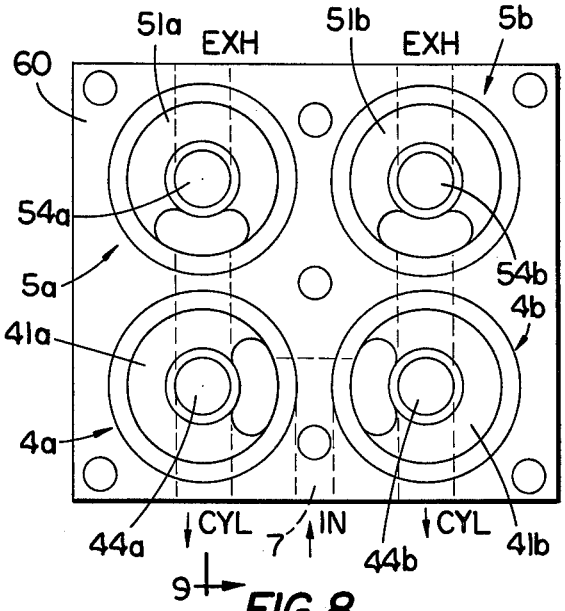
Figure 9:
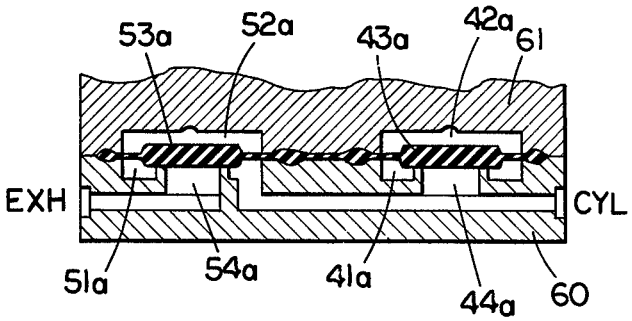
Figure 11:
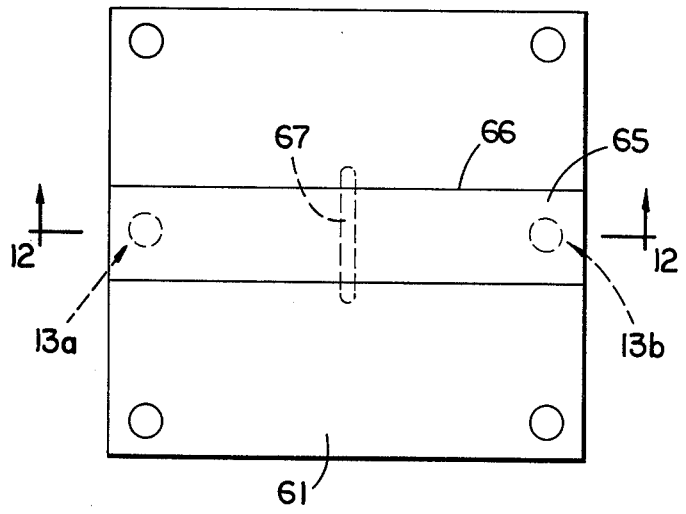
Figure 12:
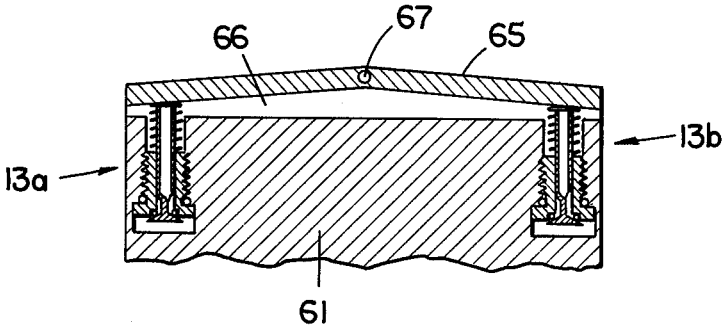
Figure 13:
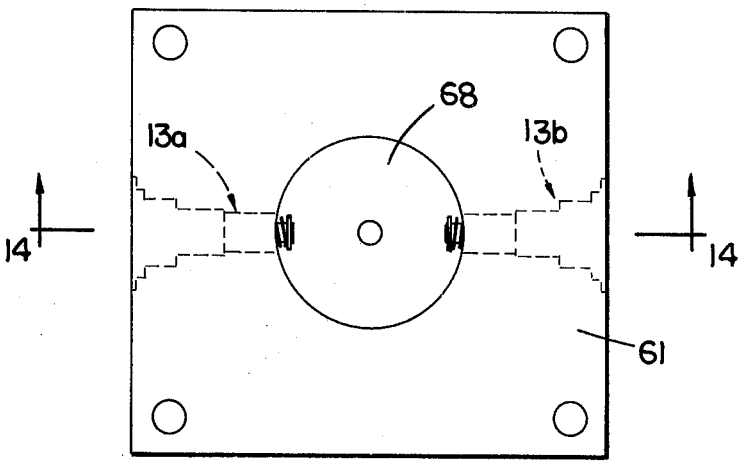
Figure 14:
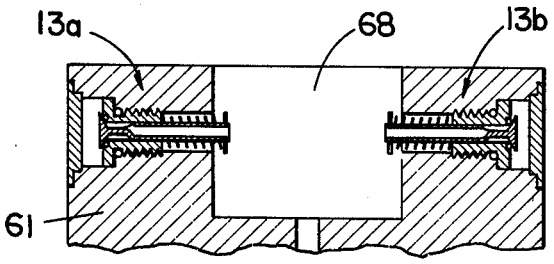

FIGS. 3*a*, 3*b* and 3*c* are diagrammatic illustrations of the valve assembly of FIG. 1 connected to a single acting cylinder and showing the assembly under different operating conditions;

FIG. 4 is a section through a modified diaphragm for use in the valves of FIG. 1;

FIGS. 5 and 6 are similar sections through the control means of the valve assembly of FIG. 1 and showing two operative conditions of the control means;

FIGS. 7 and 8 are plan views of two parts of another embodiment of a valve assembly according to the present invention and showing the chambers of the valves of the assembly;

FIG. 9 is a section on the line 9—9 of FIGS. 7 and 8;

FIGS. 10*a*, 10*b*, 10*c*, 10*d*, 10*e*, 10*f* and 10*g* are diagrammatic illustrations of the valve assembly of FIGS. 7 to 9 connected to a double acting cylinder and showing the various operating conditions of the assembly;

FIG. 11 is a plan view from the other side of the part shown in FIG. 7;

FIG. 12 is a section on the line 12—12 of FIG. 11;

FIG. 13 is a plan view of the other side of a modification of a part shown in FIG. 7; and FIG. 14 is a section on the line 14—14 of FIG. 13.

Figure 2:
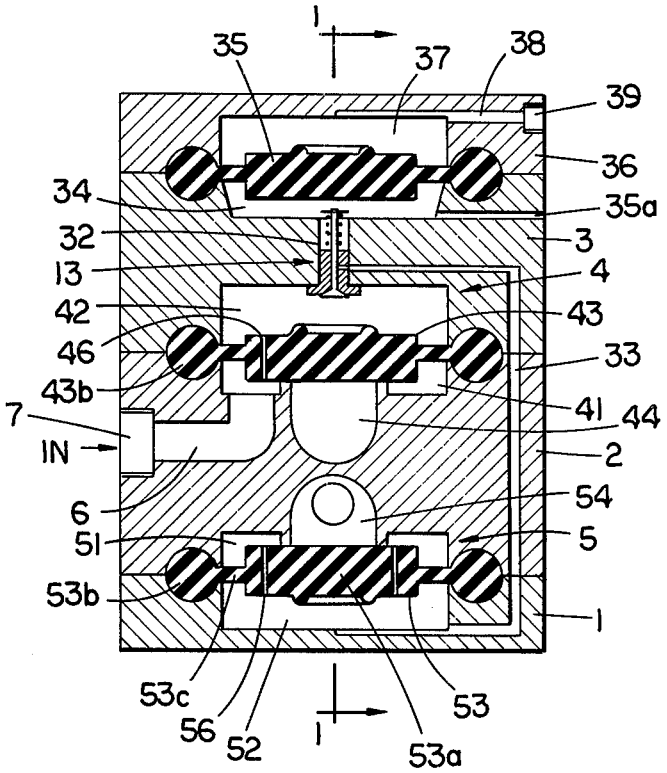
FIG. 2 is a section through the valve assembly of FIG. 1 and on the line 2—2 of FIG. 1.

As shown in FIGS. 1 and 2, a three port pneumatic valve assembly, for example for operating a single acting cylinder, comprises three cylindrical body members 1, 2 and 3 which are held together by bolts (not shown) extending through suitably located co-axial apertures (not shown) in the members. The members 1 to 3 define two diaphragm valves 4, 5 of which each comprises a first chamber 41, 51, a second chamber 42, 52 separated from the first chamber by a diaphragm 43, 53, and a port 44, 54 for communication with the first chamber and normally closed by the diaphragm. The first chamber 41 of the first valve 4 communicates via a duct 6 with an inlet port 7 which is adapted for connection to a supply of air under pressure. The port 44 communicates via a duct 8 with a cylinder port 9 for connection to the cylinder and via a duct 10, branching from duct 8, with the first chamber 51 of the second valve 5. The port 54 of the second valve 5 communicates via a duct 11 with an exhaust port 12 providing a return path for air from the cylinder.

The second chambers 42, 52 of the valves are connected to a pilot valve 13 which is placeable in three conditions, in a first of which the second chambers 42, 52 are placed in communication, in a second of which the second chambers are isolated from each other and the second chamber 52 is connected to exhaust, and in a third of which the second chambers are isolated from each other and from exhaust. The construction and operation of the pilot valve will be described hereafter.

Each valve 4, 5 includes bleed means placing the two chambers 41, 42 and 51, 52 of each valve in communication. The bleed means may, as shown, take the form of one or more passageways 46, 56 in the diaphragm. However, it will be appreciated tht the bleed means could alternatively be provided by ducts through the body members and opening into the chambers.

As shown, each diaphragm 43, 53 has a central thickened portion 43*a*, 53*a* which is relatively rigid and by which the port 44, 54 is closed, and a peripheral bead 43*b*, 53*b* which is received in corresponding annular recesses in the mating faces of the body members 1 and 2 and 2 and 3 and by which the junction between the body members is sealed. The annular portion 43*c*, 53*c* of each diaphragm between the bead and the thickened portion is planar and flexible. Each diaphragm may be made of rubber with the central thickened portion rigidified by a nylon disc insert. Alternatively, as shown in FIG. 4, the annular flexible portion 63*c* of each diaphragm between the bead 63*b* and thickened central portion 63*a* may have a U-section. The bleed passageways may be formed, as shown, directly in the diaphragm or may be formed in an insert, e.g. of stainless steel, bonded into the diaphragm. Each bleed passageway may be provided with a filter cap to prevent blocking of the passageway in the event that the pressurised fluid is dirty.

The pilot valve 13 may take the form shown in FIGS. 5 and 6. This valve comprises a fixed body 20 having a through-bore 21 and externally threaded. A spindle 22 is slidably received in the bore in the body and has a blind bore 23 opening at one end 24. The closed end of the bore 23 has an elongate radial opening 25. Beyond the closed end of the bore 23, the spindle is of reduced section and terminates in a frusto conical valve member 26 which seats against an annular seal 27 in the corresponding end of the body 20. The spindle 22 is biased in a direction to seat the valve member 26 by a spring 28 acting between the other end of the body 20 and a circlip 29 engaged on the corresponding end of the spindle. The body 20 is provided with a radial bore 30 communicating with an internal groove 31 which permits communication between the bore 30 and the opening 25 in all angular and axial operative positions of the spindle 22.

As shown in FIGS. 1 and 2 of the above described pilot valve 13 is screwed into a bore 32 in the end of the second chamber 42 of the first valve 4 with the valve member 26 facing the chamber 42. The radial bore 30 in the body 20 is connected via a duct 33 with the second chamber 52 of the second valve 5 and the open end 24 of the blind bore 23 communicates with a further chamber 34 formed in the end of the body member 3 and connected via a duct 38 to the atmosphere.

The operation of the above described assembly with port 9 connected to chamber 14 (FIGS. 3*a*, 3*b* and 3*c*) of a single acting cylinder 15 is as follows. To maintain the piston of the cylinder in a fixed position, the pilot valve 13 is placed in the condition shown in FIG. 5 and with the end 24 of the bore 23 in the spindle closed (FIG. 3*a*), the closed condition of the spindle bore being indicated schematically by a transverse line in FIG. 3*a*, its open condition by an arrow in FIG. 3*b*. With the pilot valve in this condition, the two second chambers 42, 52 are isolated from each other and from exhaust to atmosphere. The pressures in the first and second chamber of each valve are equal because of the presence of the bleed passageways so that both diaphragms maintain the corresponding ports 44 and 54 closed. No air will therefore flow through the system. To drive the piston towards the left hand side, as shown in FIGS. 3*c*, the pilot valve is moved to a condition shown in FIG. 6 and the end 24 of the bore 23 is maintained closed so that the two second chambers 42, 52 are placed in communication with each other (FIG. 3*c*). Air from the chamber 42 flows through the pilot valve and duct 33 into chamber 52, which is initially at a lower pressure, to reduce the pressure in chamber 42. The forces on the diaphragm 43 are therefore no longer balanced so that the diaphragm lifts under the inlet air pressure in chamber 41 to place port 44 in communication with chamber 41 as shown in FIG. 3*c*. Air from the inlet will then flow through port 44 and duct 8 to the cylinder. At the same time air bleeds through the diaphragm 43 into chamber 42 and flows via duct 33 to chamber 52, via the bleed passageways in diaphragm 53 to chamber 51 and via ducts 10 and 8 to the cylinder. To prevent undue build up of pressure in chamber 52, which would cause the first valve to close, a faster bleed rate of flow is provided through diaphragm 53 than through diaphragm 43. This may be obtained by providing more passageways in diaphragm 53 or providing one or more larger passageways. To halt the flow of air to the cylinder, communication between chambers 42 and 52 is closed by moving the valve 13 back to its initial condition (FIG. 3*a*). As soon as this occurs the pressures on the faces of the diaphragms 43 and 53 equalize because of the presence of the bleed passageways and the port 44 is therefore closed by the diaphragm 43.

To permit the piston to move in the opposite direction, the pilot valve is placed in the condition shown in FIG. 5 but with the end 24 of bore 23 open. In this condition, while the chambers 42, 52 are isolated from each other, chamber 52 is open to exhaust (FIG. 3*b*). The pressure in this chamber is therefore reduced which allows diaphragm 53 to lift under the pressure of air in the cylinder to place the port 54 in communication with chamber 51 and thereby the cylinder in communication with exhaust. It will be appreciated that the movement of the piston can be controlled by varying the degree of opening of the bore 23 to exhaust. Flow of air from the cylinder ceases as soon as the valve 13 is returned to its initial condition. Thereupon the pressure across the diaphragm 53 equalizes by flow of air through the bleed passageways so that the diaphragm 53 returns to its position closing port 54.

It will be appreciated that the pilot valve may be actuated in a number of different ways, it merely being necessary for the actuator to be such as can close the end 24 of the bore 23 of the spindle. The actuation may be pneumatic, hydraulic, electrical or manual. If electrically actuated, the actuation may be effected by a solenoid whose armature acts on the spindle of the valve both to move the spindle and to close the open end 24 of the bore. A form of pneumatic actuation is shown in FIGS. 1 and 2 in which the valve 13 is actuated by a diaphragm 35, similar to the diaphragms 43 and 53 except that it does not include bleed passageways. The diaphragm 35 is located between the end of member 3 and a fourth body member 36 which is bolted to members 1 to 3. The diaphragm 35 separates the chamber 34 from a control chamber 37 connected via a duct 38 to a control port 39. Air is supplied to the control port 39 either to provide a coarse control in which the valve 13 is only placeable in the two conditions illustrated in FIGS. 3*b* and 3*c* or to provide a fine control by which the valve is also placeable in the condition shown in FIG. 3*a* and the extent of opening of the end 24 of the bore of the pilot valve spindle may also be controlled.

It will also be appreciated that the above described pilot valve 13 may be replaced by any other type of control valve which is placeable in at least the two conditions illustrated in FIGS. 3*b* and 3*c*.

The above described assembly may be duplicated and used to control a double acting cylinder. Such a control may be effected simply by providing two valve assemblies as above described, each with its own control means, and with a common or two associated control means actuators. Alternatively such a double valve assembly may be as shown in FIGS. 7 to 10. As shown in FIGS. 7 to 9, the two pairs of valves 4*a*, 5*a* and 4*b*, 5*b* are defined between two rectangular blocks 60, 61 which are bolted together. One block 60 defines the four first chambers 41*a*, 51*a* and 41*b*, 51*b* and ports 44*a* and 54*a* and the other block 61 defines the four second chambers 42*a*, 52*a* and 42*b*, 52*b*. The diaphragms 43*a*, 53*a* and 43*b*, 53*b* may be provided individually as in the preceding embodiment or as modifed in FIG. 4, or may be molded as a single component as shown in FIG. 9.

The first chambers 41*a* and 41*b* of the two first valves have a common inlet port 7 but otherwise the first chambers and ports of the pairs of valves are connected together as previously described. The second chambers of the four valves are also connected in pairs as previously described, each pair to a pilot valve 13*a*, 13*b*.

Figure 10A:
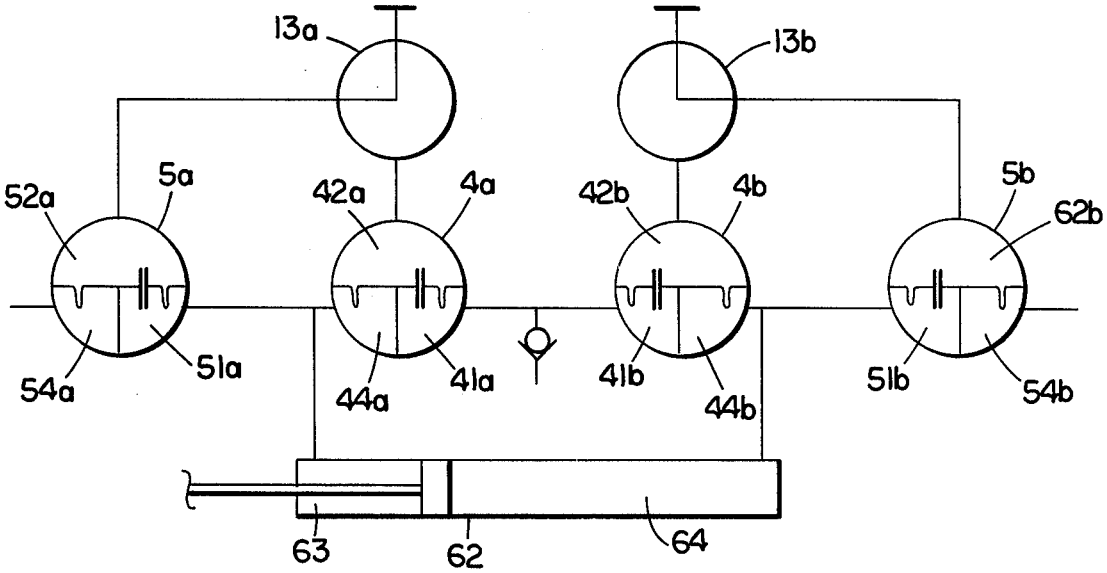
Figure 10B:
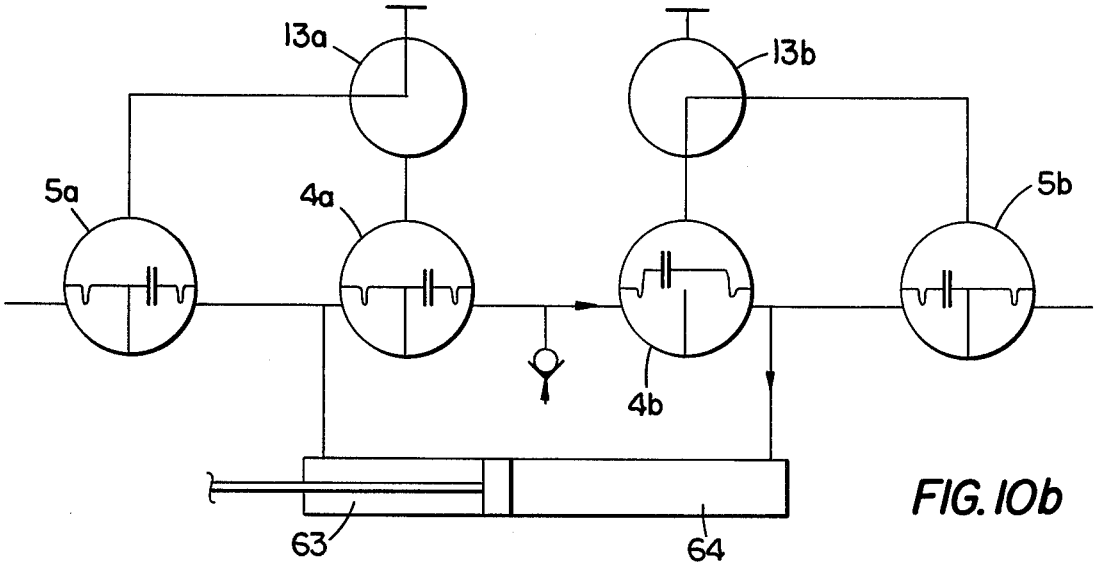
Figure 10C:
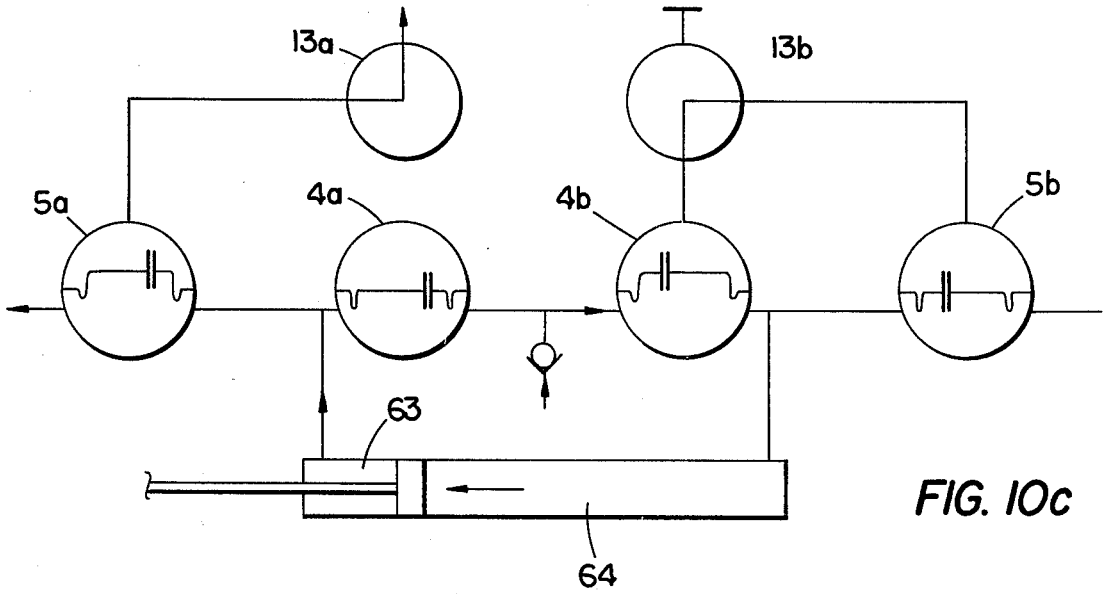
Figure 10D:
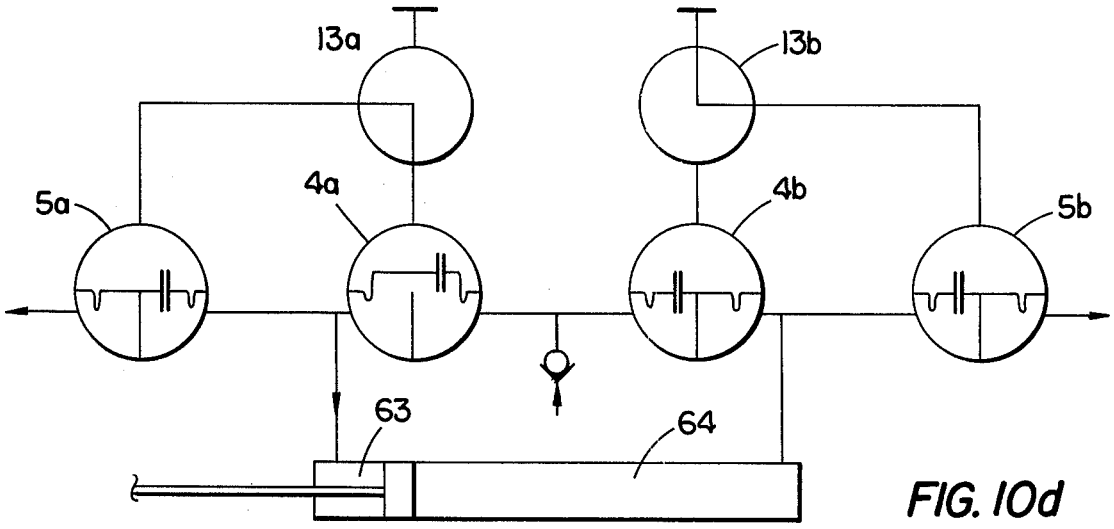
Figure 10E:
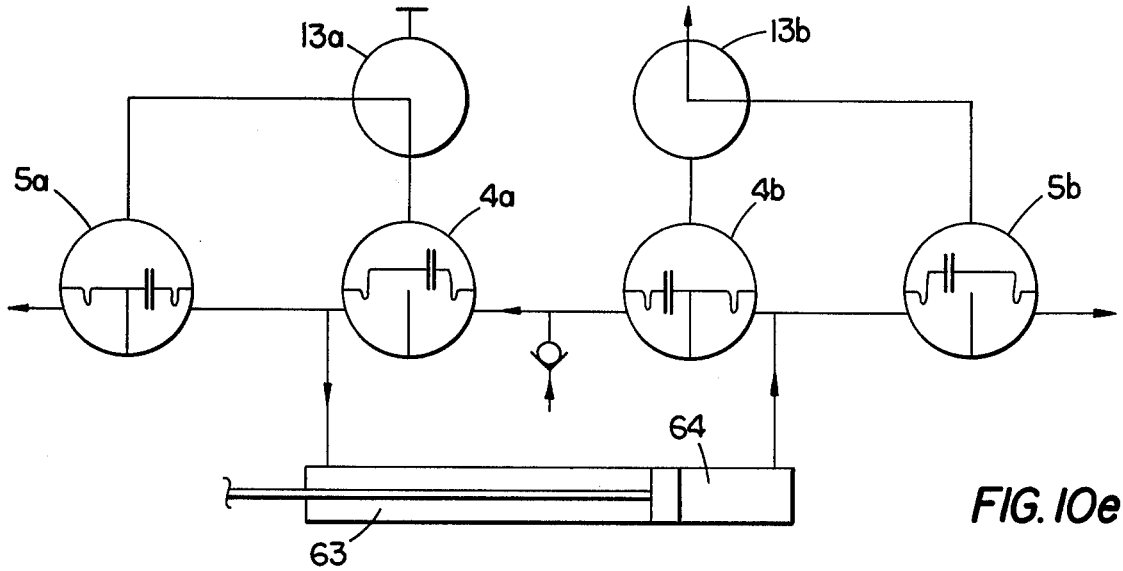
Figure 10F:
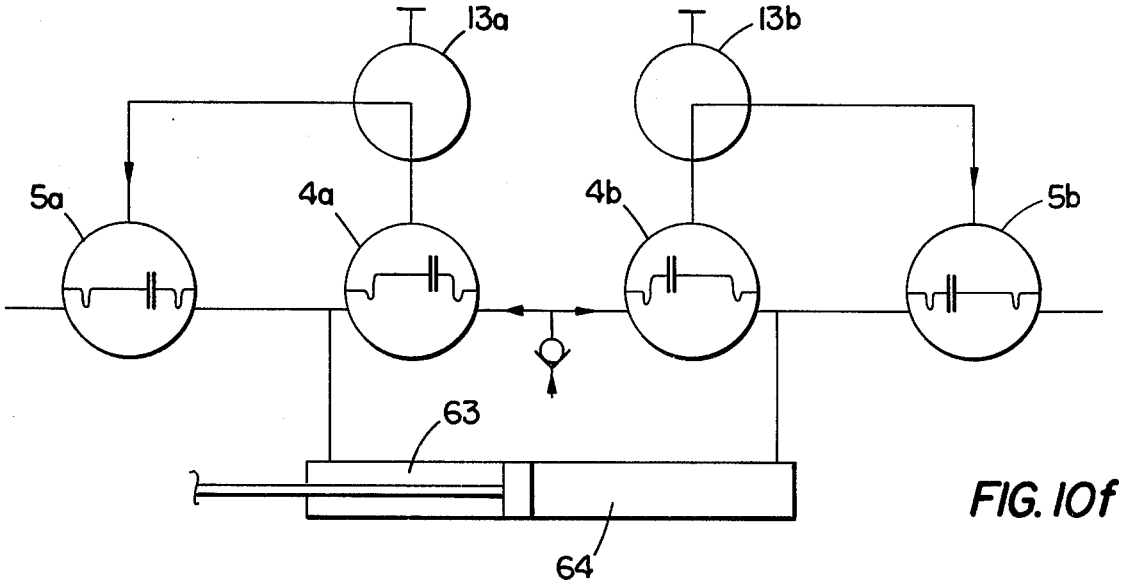
Figure 10G:
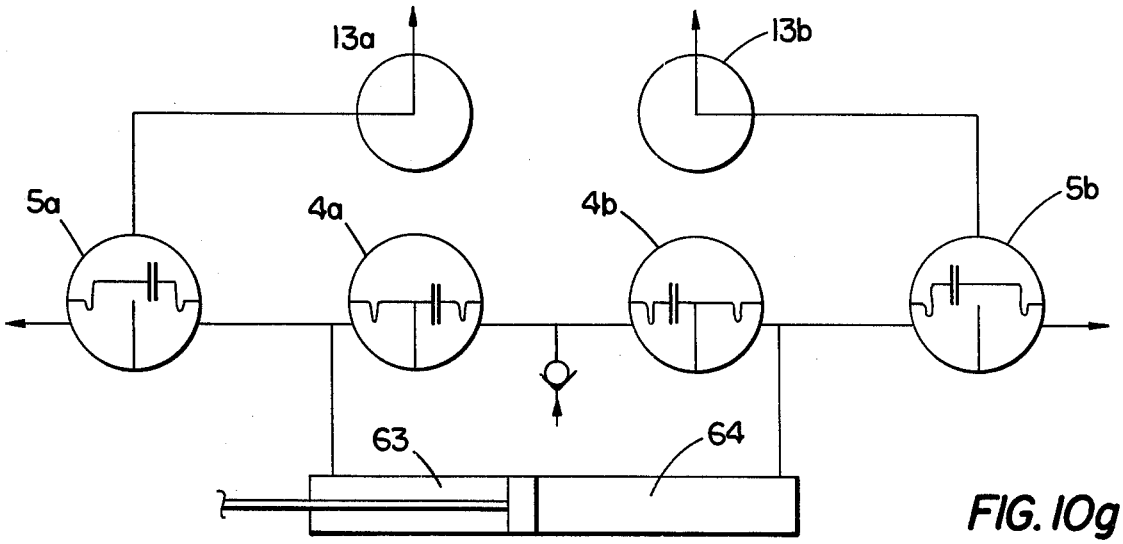

The various conditions of operation of the above described assembly are illustrated in FIGS. 10*a* to 10*g* where the assembly is shown connected to a double acting cylinder 22, valves 4a and 5a controlling the supply of air to chamber 63 of the cylinder and valves 4b and 5b being connected to control the supply of air to the other chamber 64. FIG. 10a illustrates the situation where both pilot valves 13a and 13b are in the condition shown in FIG. 3a in which no air will flow through the system and the piston is maintained in position. In FIG. 10c the pilot valve 13a is in the condition shown in FIG. 3b and the pilot valve 13b is in the condition shown in FIG. 3c. In this condition pressurized air will flow through valve 4b into chamber 64 of the cylinder and will be exhausted from chamber 63 via valve 5a to drive the piston to the left hand side of FIG. 10c. This condition may be immediately preceded by one as shown in FIG. 10b in which the pilot valve 13b is in the condition shown in FIG. 3c but the pilot valve 13a is still in the condition shown in FIG. 3a (or as shown in FIG. 10a) in which exhaust of chamber 63 is blocked so that the piston is cushioned. Thereafter the connection of pilot valve 13a to exhaust (FIG. 10c) may be controlled to control the movement of the piston towards the left hand side as shown in FIG. 10c. In FIG. 10e the valve 13a is in the condition shown in FIG. 3c and the valve 13b is in the condition shown in FIG. 3b so that the piston will be driven to the right hand side of FIG. 10e, pressurised air being supplied to chamber 63 via valve 4a and being exhausted from chamber 64 via valve 5b. Again this condition may be immediately preceded by one as shown in FIG. 10d in which the piston is cushioned and thereafter movement of the piston may be controlled. In FIG. 10f both pilot valves are in the condition shown in FIG. 3c so that both chambers 63 and 64 of the cylinder are connected to the pressurised air supply. In FIG. 10g both pilot valves are in the condition shown in FIG. 3b so that both chambers of the cylinder are connected to exhaust.

The pilot valves 13a, 13b are advantageously operated by a single actuator, for example as shown in FIGS. 11 to 14. In FIGS. 11 and 12 the pilot valves 13a, 13b are arranged in the body 61 in spaced parallel orientation for operation manually by a bar 65 which is mounted in a recess 66 in the top of body 61 for pivotal movement about a pin 67. The bar is normally in a position closing the ends 24 of the spindles of both valves and the assembly is thus in the condition shown in FIG. 10a. The assembly can be placed in the condition shown in FIG. 10c by tilting the bar 65 clockwise and can be placed in the condition shown in FIG. 10e by tilting the bar anti-clockwise. Preferably the bar 65 is made flexible so that both arms can be simultaneously depressed to place the assembly in the condition shown in FIG. 10f.

In FIGS. 13 and 14, the top of body 61 is provided with a cylindrical recess 68 for receiving a solenoid (not shown) whose armature is aligned with the two co-axial pilot valves 13a, 13b. The solenoid is arranged so that normally it closes the end 24 of the spindles of both valves, placing the assembly in the condition shown in FIG. 10a. Energization of the solenoid to move the armature to the left or right hand side produces the condition of FIG. 10a or FIG. 10c in the assembly. This arrangement using a solenoid actuator for the pilot valve 13a, 13b does not allow the possibility of placing the assembly in the condition of FIG. 10f. This possibility could be provided for by replacing the solenoid with a single armature by one with a pair of armatures which can either move together to produce the conditions of FIGS. 10a, 10c and 10e or can be moved in opposite directions to produce the conditions shown in FIG. 10f and 10g. Such an actuator may also be controlled so as to produce the conditions of FIGS. 10b and 10d.

It will be noted that in FIGS. 11 to 14 the paths of the various ducts connecting the second chambers to the pilot valves have not been shown. It will be appreciated that these paths can be located howsoever is most convenient, it merely being necessary for the second chambers 52a, 52b to be connected to the ends of the respective pilot valves provided with the valve members 26 and the second chambers 52a, 52b to be connected to the radial bores 30 (not shown in FIGS. 12 and 14).

While the above five port valve assembly is described as having a common inlet port 7, it will be appreciated that two inlet ports may be provided, one connected to each first chamber of each first valve, and for connection, for example, to fluid supplies at different pressures. Such a valve assembly will of course be a six port valve assembly. Equally each of the above valve assemblies may be provided with a single exhaust port connected to the ports of the second valves, instead of the separate exhaust ports shown, so making the assemblies four and five port valve assemblies.

It will be appreciated that a three port valve assembly may be constructed with the valve diaphragms coplanar as in the above described five port valve assembly.

The above described valve assemblies may be cheap and are simple to manufacture because they can be made of plastics material. They have a fast response time and are economic in their usage of pressurized fluid because effectively the only fluid exhausted is that in the cylinder. They are also highly controllable and can provide a metering control as well as a simple on-off control.

It will be appreciated that three or more pairs of valves may be associated to control a more complex cylinder and piston assembly.

The body members of the above described valve assemblies may be made of metal, as is conventional, or may be molded of plastics.

While the above assemblies have been described in terms of controlling pressurized air flow, it will be appreciated that they are equally suitable for controlling flow of hydraulic fluid.

I claim:

1. A diaphragm valve assembly comprising a first and a second diaphragm valve each comprising a first and a second chamber separated by a diaphragm, a valve port for communication with the first chamber and normally closed by the diaphragm, bleed means connecting the first and second chambers, and control means for actuating the valve, wherein the first chamber of the first valve has an inlet for communication with a supply of fluid under pressure, the port of the first valve is adapted for connection to apparatus to be controlled by fluid under pressure and is connected to the first chamber of the second valve, the port of the second valve is adapted for connection to exhaust, and the second chambers of the valves are connected to the control means which is placeable in at least two conditions in a first of which the pressure in the second chamber of the first valve will be reduced relative to that in the first chamber to permit the diaphragm of the first valve to lift to open the port thereof and in a second of which the pressure in the second chamber of the second valve will be reduced relative to that in the first chamber to permit the diaphragm of the second valve to lift to open the port thereof.

2. An assembly as claimed in claim 1, wherein in the first condition of the control means the second chambers of the valves are placed in communication and in the second condition of the control means the second chambers are isolated from each other and the second chamber of the second valve is connected to exhaust.

3. An assembly as claimed in claim 1, wherein the first condition of the control means the second chambers of the valves are placed in communication and in the second condition of the control means the second chambers are isolated from each other and the second chamber of the second valve is connected to exhaust and wherein the control means is placeable in a third condition in which the second chambers are isolated from each other and from exhaust.

4. An assembly as claimed in claim 1, comprising a first body member having opposed faces in which the first chambers of the valves are defined, and second body members each defining the second chamber of a respective one of the valves in a face thereof, the diaphragms being located between the corresponding faces of the body members and sealing the junctions therebetween.

5. An assembly as claimed in claim 1, comprising a first body member defining the first chambers of the valves in a face thereof, and a second body member defining the second chambers of the valves in a face thereof, the diaphragms being located between the faces of the body members and sealing the junction therebetween.

6. An assembly as claimed in claim 1, wherein the control means comprising a body member providing a seat for a valve member with one side of which the second chamber of the first valve communicates, with the other side of which the second chamber of the second valve communicates, and passage means placing the other side of the seat in communication with the return path, the passage means being closable by an actuator for moving the valve member.

7. An assembly as claimed in claim 6, wherein the control means comprises a spindle extending from the valve member on the other side of the seat and formed with an axially extending bore which is open axially at that end of the spindle remote from the valve member and there communicates with exhaust and communicates with the second chamber of the second valve through a radial opening in the spindle, the actuator acting on the said remote end of the spindle to close communication with exhaust.

8. A diaphragm valve assembly comprising two diaphragm valve assemblies as claimed in claim 1, wherein the inlets of the first chambers of the first valves are connectable to a common supply of fluid under pressure and common actuating means are provided for actuating the control means of the first and second valves.

9. A diaphragm valve assembly comprising two diaphragm valve assemblies as claimed in claim 1, wherein the inlets of the first chamber of the first valves are connectable to a common supply of fluid under pressure and common actuating means are provided for actuating the control means of the first and second valves and wherein the actuating means are arranged such that the control means are normally in a third condition in which the second chambers are isolated from each other and from exhaust and wherein the actuating means is movable to a first position to place one control means in its first condition and the other control means in its second condition and to a second position to place the one control means in its second condition and the other control means in its first condition.

* * * * *